United States Patent [19]

MacDonald

[11] 4,288,137

[45] Sep. 8, 1981

[54] DRAWER SLIDE SYSTEM

[75] Inventor: Paul M. MacDonald, Scituate, Mass.

[73] Assignee: Dickran Babigian, West Newton, Mass.

[21] Appl. No.: 122,351

[22] Filed: Feb. 19, 1980

[51] Int. Cl.[3] ..... A47B 88/04; F16C 21/00

[52] U.S. Cl. ..... 312/341 R; 312/330 R; 312/338; 312/350; 308/3.8

[58] Field of Search ..... 312/341 R, 330 R, 333, 312/338, 350; 308/3.8

[56] References Cited

U.S. PATENT DOCUMENTS

| | | | |
|---|---|---|---|
| 2,325,896 | 8/1943 | Waller | 308/3.8 |
| 3,352,617 | 11/1967 | Dargene | 308/3.8 |
| 3,387,907 | 6/1968 | Wall | 312/341 R |
| 3,490,823 | 1/1970 | Neu et al. | 312/330 |
| 3,574,437 | 4/1971 | Stein | 308/3.8 |
| 3,664,716 | 5/1972 | Johnson | 308/3.8 |
| 4,065,196 | 12/1977 | Stein | 312/341 R |
| 4,119,377 | 10/1978 | Barber et al. | 312/341 R |
| 4,121,878 | 10/1978 | Lokken | 312/341 R |
| 4,176,890 | 12/1979 | Gorton | 312/341 R |

FOREIGN PATENT DOCUMENTS

| | | | |
|---|---|---|---|
| 2742210 | 3/1979 | Fed. Rep. of Germany | 312/350 |
| 1236644 | 6/1960 | France | 312/341 R |

*Primary Examiner*—Victor N. Sakran

*Attorney, Agent, or Firm*—Morse, Altman, Oates & Dacey

[57] ABSTRACT

A drawer slide system is provided in which cooperating rollers and tracks are mounted to the sides of the drawer and to the frame of the cabinet in which the drawer is mounted. The drawer mounted component comprises a track having an L-shaped cross-section mountable flush against the side of the drawer with the upper edge thereof even with the upper edge of the drawer. A roller is mounted near the rear end of the track and an arcuate indent is formed near the forward end thereof. The cabinet-mounted component includes a rail of U-shaped cross-section the end of which is mounted by means of a bracket to the rear wall of the cabinet and the forward end is formed with a depending flange on which is mounted a roller. The roller on the drawer component rides in the U-shaped rail while the roller on the cabinet component supports the drawer rail. The drawer rail is contoured to maintain clearance between the cabinet roller and the drawer.

5 Claims, 8 Drawing Figures

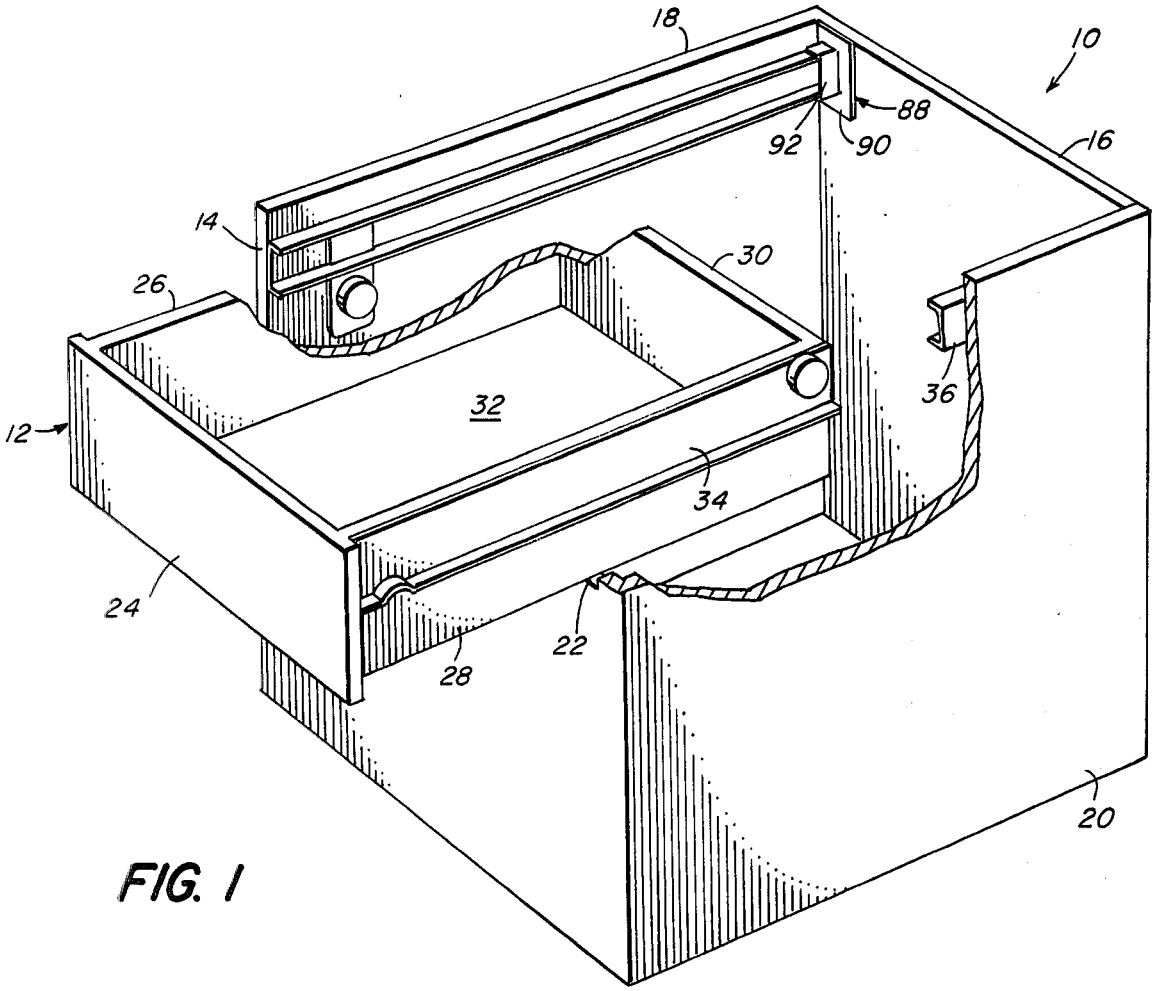
FIG. 1
FIG. 2
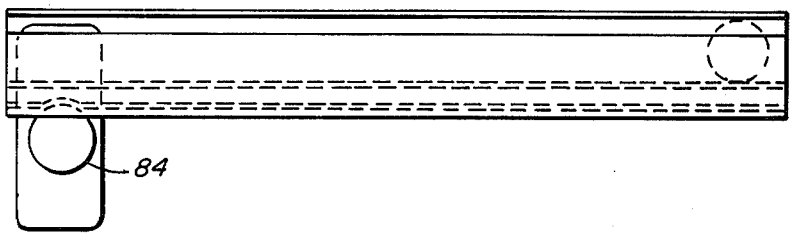
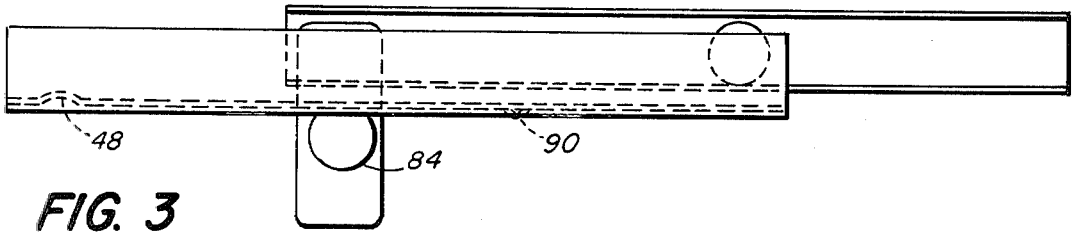
FIG. 3

DRAWER SLIDE SYSTEM

BACKGROUND OF THE INVENTION

1. Field of the Invention

This invention relates generally to slide systems for drawers and more particularly is directed towards a new and improved drawer slide arrangement characterized by ease of installation and smooth operation.

2. Description of the Prior Art

Drawers for cabinets and the like have been mounted by a variety of different means ranging from simple friction slide arrangements to rather elaborate roller and rail systems for use in handling heavily loaded drawers subject to frequent use. The roller and rail type drawer slide systems heretofore available have displayed certain drawbacks which include complex and expensive construction, difficulty of installation involving the need for special jigs and the like and the drawer itself tended to shift from side to side to some extent unless great care was taken in the assembly of precision designed fittings.

It is an object of the present invention to provide improvements in drawer slides sytems.

Another object of this invention is to provide a simple, low cost drawer slide system that is quickly and easily installed without the use of special jigs.

A further object of this invention is to provide a side mounted drawer slide system employing a minimum number of components and which provides inherent straight line movement of the drawer without side movement thereof.

SUMMARY OF THE INVENTION

This invention features a slide system for mounting a drawer to a cabinet, comprising a set of rails for each drawer, each set including a pair of cooperating rails for each side of the drawer. Each pair of rails includes a drawer-mountable rail and a cabinet-mountable rail. The drawer-mountable rail includes an elongated member of L-shaped cross-section mountable along the upper edge of the side of the drawer and provided with a roller near the rear end thereof and a indent along the forward end thereof. The cabinet-mounted rail is an elongated member of U-shaped cross-section formed with a depending flange near the forward end thereof and a roller mounted to the lower portion of the flange. When assembled together, the roller of the drawer-mountable rail is fitted for movement in the channel of the cabinet-mountable rail while the roller for the cabinet-mountable rail supports the lower edge of the drawer-mountable rail. The flange of the drawer-mountable rail is formed with a longitudinal bevel to maintain the drawer out of rubbing contact with the cabinet.

BRIEF DESCRIPTION OF THE DRAWINGS

FIG. 1 is a view in perspective, partially broken away, showing a drawer rail system made according to the invention installed in a typical cabinet, FIG. 2 is a view in side elevation of the drawer rails only and in closed position, FIG. 3 is a view similar to FIG. 2 showing the rails in an open position.

DETAILED DESCRIPTION OF THE PREFERRED EMBODIMENT

Figure 6:
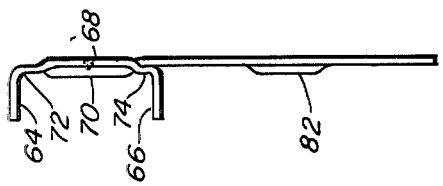
FIG. 6 is a view in end elevation thereof.

Referring now to the drawings, the reference character 10 generally indicates a cabinet of typical construction and provided with a drawer 12 mounted for sliding movement with respect thereto. The cabinet 10 may be of standard construction in the form of a vanity, kitchen cabinet, or any other type of cabinet with one or more drawers and includes front and rear walls 14 and 16 and side walls 18 and 20. The front wall is formed with a rectangular opening 22 to accommodate the drawer 12 which is of typical construction having a front panel 24, side walls 26 and 28, a rear wall 30 and a bottom wall 32.

Each side of the drawer is slidably supported to the cabinet by a pair of rails, one being a drawer-mountable rail 34 and the other being a cabinet-mountable 36. Insofar as the pair of rails 34 and 36 on one side of the drawer are mirror images of the rails on the opposite side, only one pair of rails will be described in detail.

Figure 8:
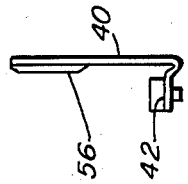
Figure 5:
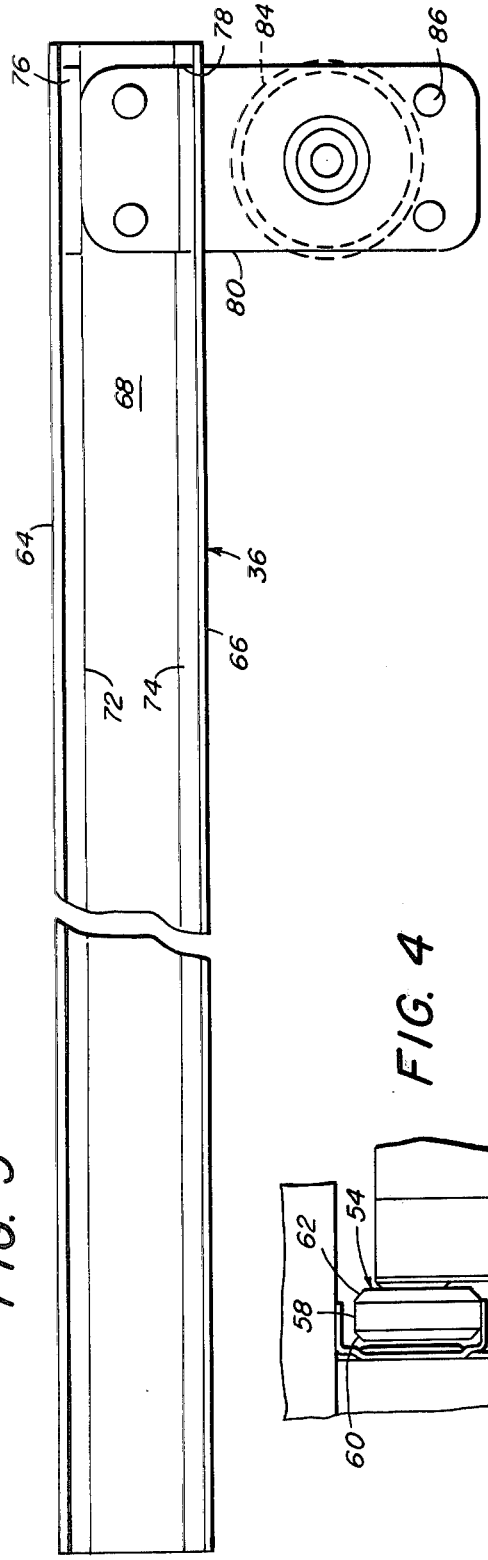
FIG. 5 is a view in side elevation of the cabinet-mountable rail.
Figure 7:
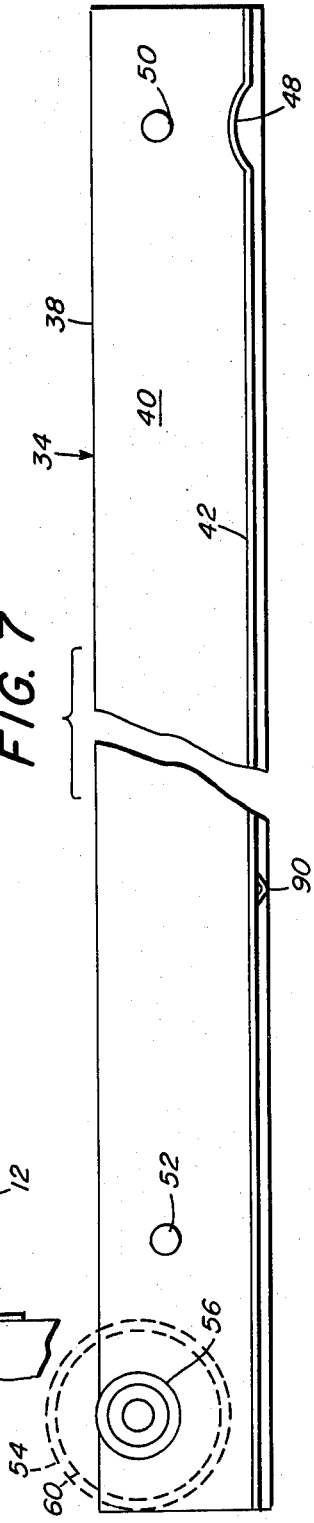
FIG. 7 is a view in side elevation of the drawer-mountable rail, and, FIG. 8 is a view in end elevation thereof.

The drawer mountable rail 34, as best shown in FIGS. 7 and 8, is comprised of a track 38 fabricated from a suitable material such as steel, aluminum or the like and in the form of an elongated rectangle, L-shaped in cross section and including an upright side portion 40 from the lower edge of which extends a flange 42 extending the full length of the track. The flange 42 is formed with a straight, flat portion 44 which is generally perpendicular to the side portion 40 and a bent portion 46 extending at an angle of approximately 45° between the flat portion 44 and the lower edge vertical portion 40.

While the rail 34 may be fabricated in a variety of different sizes in practice, a typical length for a standard cabinet and drawer would be on the order of about 19" and a height of perhaps an inch or so with a shelf or flange depth on the order of ¼" to ½". These dimensions are only by way of example and obviously may be increased or decreased according to the size of the drawer with which is to be used and other factors.

The forward end of the flange 42 is formed in its lower face with an arcuate indent 48 for reasons that will presently appear. The side portion 40 is formed with spaced openings 50 and 52 to receive fastening means such as screws, nails, rivets and the like for mounting the rail to the drawer. Near the rear end of the rail in the side portion 40 near the upper edge thereof is mounted a roller 54, preferably of nylon or similar material. The roller 54 is mounted to the rail at the center of a boss 56 formed in the side portion 40 in order to maintain the roller 54 away from the surface of the rail and to prevent rubbing therewith. While the roller dimensions may vary, a typical roller size would be on the order of 1" in diameter and perhaps ¼" thick. In the preferred embodiment, the roller should be formed with a cylindrical outer rolling surface 58 between chamfered edges 60 and 62.

The drawer rail is mounted to the side wall 28 of the drawer so that its upper edge is level with the top of the drawer. Once the rail is in this position, it is secured to the drawer as by screws or staples. The rail is mounted in the manner shown in FIG. 1 extending lengthwise along the outside surface of the side of the drawer with the roller 54 at the rear and the flange 42 positioned at the lower portion of the rail and extending outwardly from the face of the drawer side. Since the rail 34 is installed by merely positioning the upper edge of the rail even with the upper edge of the side of the drawer, no special jigs or other tools are required for installation, greatly facilitating assembly of the system.

The rail 36 mountable to the cabinet frame typically is of the same material as the drawer rail 34 and is of a U-shaped, channel construction with a length typically slightly greater than that of the drawer rail and, in practice, is on the order of about 23" when used in an average drawer assembly. The cabinet rail 36 typically is about an inch or so in height and a depth of perhaps $\frac{3}{4}$". The rail includes upper and lower parallel flanges 64 and 66 extending from upper and lower edges of a side wall 68 having a longitudinally recessed center portion 70. The recessed portion defines upper and lower offset portions 72 and 74 which are cut away at 76 and 78 at the forward portion of the rail to receive a plate 80 mounted and welded flat against the rear wall 68 and extending downwardly therefrom. The plate 80 is formed with a boss 82 in the center of which is mounted a roller 84, similar in size, shape and construction to the roller 54. The plate 80 is formed with a plurality of openings 86 to receive fasteners such as screws, rivets and the like by means of which the forward portion of the rail may be assembled to the cabinet. The rear end of the rail is mounted to the rear wall 16 of the cabinet by means of a bracket 88 stapled or otherwise fastened to the inner face of the rear wall 16. The bracket 88, in the illustrated embodiments, is formed with a flanged base portion 90 and a forwardly extending socket portion 92 of a size to receive the end of the rail 36.

When installing the rail 36 to the cabinet, the rail is mounted to the cabinet front in the inner corner thereof, with no special jig fixtures being required. The drawer is then slid into position for proper adjustment of the two rear brackets which can then be fastened by staples or the like either to the rear wall or to an existing cross-piece if no wall is provided.

Figure 4:
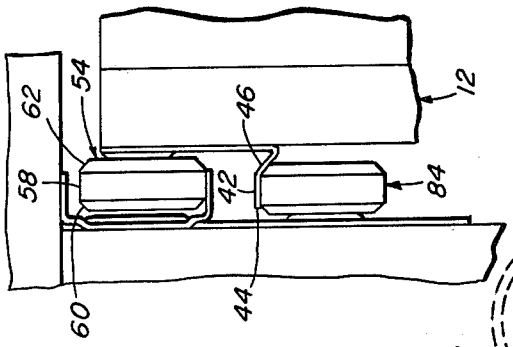
FIG. 4 is a detailed view in end elevation of a pair of drawer rails in a typical installation.

With the rails installed and the drawer in place, the roller 54 for the drawer rail will ride along the channel portion of the cabinet rail, as best shown in FIG. 4. The roller 84 of the cabinet rail supports the drawer rail with the drawer rail flange 42 riding along the top of the roller 84, as shown. It will be seen in FIG. 4 that the angle portion 46 bears against the beveled outer edge of the roller 84 to effectively prevent the drawer 12 from shifting from side to side, thereby maintaining the drawer out of contact with the roller 84. This arrangement provides a smooth action between the parts.

The indent 48 at forward end of the drawer rail serves as a stop for keeping the drawer closed and, when the drawer is shut and the rails in the position of FIG. 2, the cabinet rail roller 84 will engage the indent 48 to hold the drawer shut. The drawer may be opened by pulling on the drawer sufficiently to move the indent 48 out of engagement with the roller 84. A small detent 90 is provided in the rear portion of the rail 34 to serve as a stop against forward movement and prevent accidental removal of the drawer. The drawer may be removed by merely tilting the drawer slightly so that the detent 90 overrides the roller 84.

While the invention has been described with particular reference to the illustrated embodiment, numerous modifications thereto will appear to those skilled in the art.

Having thus described the invention, what I claim and desire to obtain by Letters Patent of the United States is:

1. A system for slidably mounting a drawer to a cabinet, comprising (a) a pair of first members mountable to said cabinet one on each side thereof adjacent the path of travel of said drawer, and, (b) a pair of second members mountable to said drawer one on each side thereof in generally opposite facing relation to said first members, (c) each of said first members including an elongated first track of U-shaped transverse cross-section defining a channel of a length generally co-extensive with the depth of said cabinet, said first track mountable to said cabinet with said channel facing said drawer and a first roller mounted integral to said first track in predetermined spaced relation below said channel and near the forward end thereof, said first roller defining a gap with the lower portion of said channel, (d) each of said second members including an elongated second track of an L-shaped transverse cross-section defining a generally flat back portion and a rail portion perpendicular thereto and longitudinally co-extensive therewith of a length generally corresponding with the depth of said drawer, said rail extending from the lower edge of said back portion, said second track mountable to the outer face of the side of said drawer with said back portion flat against said side and said rail extending outwardly from the lower long edge thereof and below the channel of said first track into said gap to rest on top of said first roller, and a second roller mounted integral to the flat back portion of said second track above said rail near the rearward end thereof and extending into cooperative engagement with said channel said first and second rollers being generally co-planar.

2. A system according to claim 1 wherein said rail is formed with a downwardly facing indent near the forward end thereof in position to seat against said first roller when said drawer is in a closed position.

3. A system according to claim 2 wherein said rail is formed with a downwardly facing detent near the rearward end thereof in position to engage said first roller when said drawer is in an open position.

4. A system according to claim 1 wherein said rail is formed with an upwardly and outwardly inclined shoulder extending lengthwise of said rail between the lower edge of said back portion and the flat portion of said rail in position to engage the outer peripheral edge of said first roller to prevent contact thereof with said drawer, the peripheral edges of at least said first roller being chamfered.

5. A system according to claim 1 including a bracket for mounting the inner end of said first member to the rear wall of said cabinet, said bracket including a socket adapted to receive the inner end of said track and a flange extending perpendicularly to said socket for fastening to said rear wall.

* * * * *